US010407642B2

(12) United States Patent
Yokomizo et al.

(10) Patent No.: US 10,407,642 B2
(45) Date of Patent: Sep. 10, 2019

(54) LUBRICANT COMPOSITION

(71) Applicant: IDEMITSU KOSAN CO., LTD., Chiyoda-ku (JP)

(72) Inventors: Masato Yokomizo, Narashino (JP); Keiichi Narita, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/561,813

(22) PCT Filed: Mar. 29, 2016

(86) PCT No.: PCT/JP2016/060230
§ 371 (c)(1),
(2) Date: Sep. 26, 2017

(87) PCT Pub. No.: WO2016/158999
PCT Pub. Date: Oct. 6, 2016

(65) Prior Publication Data

US 2018/0119049 A1 May 3, 2018

(30) Foreign Application Priority Data

Mar. 31, 2015 (JP) ..... 2015-074400

(51) Int. Cl.

| | |
|---|---|
| ***C10M 133/04*** | (2006.01) |
| ***C10M 169/04*** | (2006.01) |
| ***C10M 137/02*** | (2006.01) |
| ***C10M 137/04*** | (2006.01) |
| ***C10M 163/00*** | (2006.01) |
| ***C10M 133/06*** | (2006.01) |
| ***C10M 101/00*** | (2006.01) |
| ***C10M 139/00*** | (2006.01) |
| ***C10M 141/12*** | (2006.01) |

(52) U.S. Cl.

CPC ..... *C10M 169/04* (2013.01); *C10M 101/00* (2013.01); *C10M 133/06* (2013.01); *C10M 137/02* (2013.01); *C10M 137/04* (2013.01); *C10M 139/00* (2013.01); *C10M 141/12* (2013.01); *C10M 163/00* (2013.01); *C10M 2203/003* (2013.01); *C10M 2203/1006* (2013.01); *C10M 2205/0285* (2013.01); *C10M 2207/028* (2013.01); *C10M 2207/262* (2013.01); *C10M 2207/289* (2013.01); *C10M 2209/084* (2013.01); *C10M 2215/04* (2013.01); *C10M 2215/26* (2013.01); *C10M 2215/28* (2013.01); *C10M 2219/046* (2013.01); *C10M 2219/106* (2013.01); *C10M 2223/04* (2013.01); *C10M 2223/041* (2013.01); *C10M 2223/049* (2013.01); *C10M 2227/06* (2013.01); *C10N 2220/021* (2013.01); *C10N 2230/02* (2013.01); *C10N 2230/04* (2013.01); *C10N 2230/06* (2013.01); *C10N 2230/08* (2013.01); *C10N 2230/42* (2013.01); *C10N 2230/76* (2013.01); *C10N 2240/045* (2013.01)

(58) Field of Classification Search

CPC ..... C10M 133/04; C10M 2215/02; C10M 2215/04

USPC ..... 508/545

See application file for complete search history.

(56) References Cited

U.S. PATENT DOCUMENTS

| | | | | |
|---|---|---|---|---|
| 9,567,547 | B2 * | 2/2017 | Sumiejski | C10M 141/12 |
| 9,574,157 | B2 * | 2/2017 | Narita | C10M 135/10 |
| 9,745,536 | B2 * | 8/2017 | Sakanoue | C10M 141/10 |
| 10,011,802 | B2 * | 7/2018 | Narita | C10M 163/00 |
| 2005/0192185 | A1 * | 9/2005 | Saathoff | C10M 141/06 508/291 |
| 2006/0084583 | A1 * | 4/2006 | Tipton | C10M 141/06 508/287 |
| 2007/0004603 | A1 * | 1/2007 | Iyer | C10M 141/10 508/441 |
| 2007/0293406 | A1 | 12/2007 | Henly et al. | |
| 2010/0105590 | A1 * | 4/2010 | Nagakari | C10M 141/00 508/508 |
| 2010/0144565 | A1 | 6/2010 | Ikeda et al. | |
| 2011/0053816 | A1 * | 3/2011 | Narita | C10M 141/10 508/408 |

(Continued)

FOREIGN PATENT DOCUMENTS

| | | |
|---|---|---|
| JP | 2001-288488 A | 10/2001 |
| JP | 2007-332377 A | 12/2007 |

(Continued)

OTHER PUBLICATIONS

International Search Report dated Jun. 28, 2016 in PCT/JP2016/060230 filed Mar. 29, 2016.

(Continued)

*Primary Examiner* — Ellen M McAvoy
(74) *Attorney, Agent, or Firm* — Oblon, McClelland, Maier & Neustadt, L.L.P.

(57) ABSTRACT

The present invention relates to a lubricating oil composition prepared by blending (A) a tertiary amine having a specific structure, (B) a metal-based detergent having a total base number according to a perchloric acid method of 50 mgKOH/g or less, (C) a metal-based detergent having a total base number according to a perchloric acid method of 150 mgKOH/g or more, (D) at least one selected from an acidic phosphate and an acidic phosphite, and (E) a lubricating base oil, which satisfies a requirement (X): the mass ratio of the metal fraction derived from the component (B) to the metal fraction derived from the component (C) (B/C) is 0.60 or less.

16 Claims, No Drawings

(56) References Cited

U.S. PATENT DOCUMENTS

| | | | | |
|---|---|---|---|---|
| 2012/0149619 | A1* | 6/2012 | Narita | C10M 163/00<br>508/433 |
| 2016/0075964 | A1 | 3/2016 | Komatsubara | |

FOREIGN PATENT DOCUMENTS

| | | | |
|---|---|---|---|
| JP | 2009-167337 | A | 7/2009 |
| JP | 2010-513695 | A1 | 4/2010 |
| JP | 2013-189565 | A | 9/2013 |
| WO | 2011/037054 | A1 | 3/2011 |
| WO | 2014/156307 | A1 | 10/2014 |
| WO | 2015/122525 | A1 | 8/2015 |

OTHER PUBLICATIONS

Office Action dated Oct 16, 2016 in Japanese Patent Application No. 2015-074400 (with English translation), 6 pages.

* cited by examiner

LUBRICANT COMPOSITION

TECHNICAL FIELD

The present invention relates to a lubricating oil composition.

BACKGROUND ART

As a transmission for use in automobiles, a metal belt-type, chain-type or toroidal continuously-variable transmission has been developed. The continuously-variable transmission carries out power transmission by the friction coefficient between the chain and the pulley therein, and therefore, the lubricating oil for continuously-variable transmission to be used for these is required to have an intermetallic friction coefficient above a certain level.

On the other hand, as a startup device, a torque converter is mounted. The torque converter transmits power while absorbing differential rotation by stirring of a lubricating oil for continuously-variable transmission, but not at a time of startup, it transmits power via a rock-up clutch to thereby reduce energy loss to secure fuel saving. For rock-up clutch control, slip control to transmit power with slipping is carried out in addition to direct fastening, and when the friction characteristics of the lubricating oil for continuously-variable transmission are unsuitable, self-excited vibration called shudder occurs. Consequently, the lubricating oil for continuously-variable transmission is required to have shudder-resistant performance. By improving the shudder-resistant performance of a lubricating oil for continuously-variable transmission, more accurate rock-up clutch control becomes possible, thereby contributing toward fuel saving by automobiles.

As a continuously-variable transmission oil, PTL 1 discloses a lubricating oil composition containing a lubricating base oil, an alkaline earth metal sulfonate or phenate, an imide compound and a phosphorus compound and satisfying a specific metal friction coefficient and a shudder preventive lifetime.

PTL 2 discloses a lubricating oil composition prepared by blending at least one phosphorus-containing compound selected from a phosphate monoester, a phosphate diester and a phosphite monoester each including a hydrocarbon group having 1 to 8 carbon atoms, and a tertiary amine compound having, as a substituent, a hydrocarbon group having 6 to 10 carbon atoms, in a base oil formed of a mineral oil and/or a synthetic oil.

PTL 3 discloses a lubricating oil composition prepared by blending a tertiary amine having a specific structure, at least any one of an acidic phosphate and an acidic phosphite, and at least any one of a metal sulfonate, a metal phenate and a metal salicylate, in a lubricating base oil.

PTL 4 discloses a lubricating oil composition prepared by blending at least any one of a primary amine, a tertiary amine, a metal sulfonate, a metal phenate and a metal salicylate, and at least any one of an acidic phosphate and an acidic phosphite, in a lubricating base oil.

The original purpose of a lubricating oil is to protect a friction surface by an oil film formed in the sliding part thereof. Accordingly, for forming a strong oil film, it is advantageous that the lubricating oil has a high viscosity. However, in the case of using a lubricating oil having a high viscosity, the power necessary for stirring the lubricating oil and for oil filling is a large energy loss to interfere with energy saving and fuel saving performance. Consequently, it is intended to lower the viscosity of a lubricating oil for reducing energy loss, in recent years.

CITATION LIST

Patent Literature

PTL 1: JP 2001-288488 A
PTL 2: JP 2009-167337 A
PTL 3: WO 2011/037054
PTL 4: JP 2013-189565 A

SUMMARY OF INVENTION

Technical Problem

Recently, in a torque converter, fastening region enlargement and slip control have become much used for further energy loss reduction. Accordingly, the friction work of a lock-up clutch increases, and therefore the lubricating oil for continuously-variable transmission is desired to have improved shudder-resistant performance (prolonged shudder preventive lifetime). The lubricating oil compositions disclosed in the above PTLs 1 to 3 have a high intermetallic friction coefficient as a continuously-variable transmission oil, but the shudder-resistant performance thereof is not sufficient as yet. The lubricating oil composition disclosed in the above PTL 4 has been tried to satisfy both a high intermetallic friction coefficient and a prolonged shudder preventive lifetime, but further improvement of these properties is desired.

As described above, the viscosity of a lubricating oil is being tried to be lowered for reducing energy loss. However, when the viscosity of a lubricating oil is too much lowered, it becomes difficult to form an oil film in a sliding part at high temperatures, therefore often causing friction increase or abnormal friction. Consequently, it is desired to lower the viscosity in an ordinary temperature range or at a temperature lower than the range while the high-temperature viscosity is kept to be high in an adequate range. This indicates the necessity of viscosity change of a lubricating oil relative to temperature change is small, that is, the necessity of a lubricating oil having an increased viscosity index (VI).

The present invention has been made in consideration of the above-mentioned situation, and an object of the present invention is to provide a lubricating oil composition having a high intermetallic friction coefficient, having a long shudder preventive lifetime and having a high viscosity index.

Solution to Problem

The present inventors have assiduously studied and, as a result, have found that, by blending a tertiary amine having a specific structure, two kinds of metal-based detergents having a specific total base number, at least one selected from an acidic phosphate and an acidic phosphite, and a lubricating base oil, and by specifically defining the mass ratio of the metal fractions derived from the two kinds of metal-based detergents to fall within a specific range, the above-mentioned problems can be solved. The present invention has been completed on the basis of the findings. Specifically, the present invention provides the following [1].

[1] A lubricating oil composition, which is prepared by blending the following components (A) to (E):

(A) a tertiary amine represented by the following general formula (1);

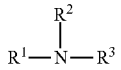

(1)

wherein $R^1$ represents a hydrocarbon group having 4 or more carbon atoms; and $R^2$ and $R^3$ each independently represent a hydrocarbon group having 1 or more and 4 or less carbon atoms, (B) a metal-based detergent having a total base number according to a perchloric acid method of 50 mgKOH/g or less, (C) a metal-based detergent having a total base number according to a perchloric acid method of 150 mgKOH/g or more, (D) at least one selected from an acidic phosphate and an acidic phosphite, (E) a lubricating base oil; and which satisfies the following requirement (X):

(X) the mass ratio of the metal fraction derived from the component (B) to the metal fraction derived from the component (C) (B/C) is 0.60 or less.

Advantageous Effects of Invention

According to the present invention, there can be provided a lubricating oil composition having a high intermetallic friction coefficient, having a long shudder preventive lifetime and having a high viscosity index.

DESCRIPTION OF EMBODIMENTS

Preferred embodiments of the present invention are described in detail hereinunder.

[Lubricating Oil Composition]

The lubricating oil composition of one aspect of the present invention is a lubricating oil composition, which is prepared by blending the following components (A) to (E);

(A) a tertiary amine represented by the following general formula (1);

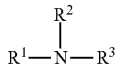

(1)

wherein $R^1$ represents a hydrocarbon group having 4 or more carbon atoms; and $R^2$ and $R^3$ each independently represent a hydrocarbon group having 1 or more and 4 or less carbon atoms, (B) a metal-based detergent having a total base number according to a perchloric acid method of 50 mgKOH/g or less, (C) a metal-based detergent having a total base number according to a perchloric acid method of 150 mgKOH/g or more, (D) at least one selected from an acidic phosphate and an acidic phosphite, (E) a lubricating base oil, and which satisfies the following requirement (X):

(X) the mass ratio of the metal fraction derived from the component (B) to the metal fraction derived from the component (C) (B/C) is 0.60 or less.

In the present invention, for example, the composition defined as "a composition prepared by blending a component (A) and a component (B)" includes not only "a composition containing a component (A) and a component (B)" but also "a composition containing, in place of at least one component of the component (A) and the component (B), a modified derivative from the corresponding component" and "a composition containing a reaction product produced by reaction of the component (A) and the component (B)".

The lubricating oil composition satisfies the following requirement (X):

(X) the mass ratio of the metal fraction derived from the component (B) to the metal fraction derived from the component (C) (B/C) is 0.60 or less.

When the mass ratio (B/C) is more than 0.60, the intermetallic friction coefficient lowers.

From this viewpoint, the mass ratio (B/C) is preferably 0.58 or less, more preferably 0.55 or less, still more preferably 0.50 or less. From the viewpoint that the lubricating oil composition can have a good shudder preventive lifetime, the mass ratio (B/C) is preferably 0.05 or more, more preferably 0.10 or more, still more preferably 0.15 or more.

By combining the above components (A) to (D) and by specifically defining the mass ratio (B/C) to fall the specific range, an excellent effect of satisfying both a high intermetallic friction coefficient and an extremely long shudder preventive lifetime can be realized.

<Component (A): Tertiary Amine>

The component (A) for use in the present invention is a tertiary amine represented by the following general formula (1). By blending the component (A) in the lubricating oil composition, the shudder preventive lifetime can be prolonged.

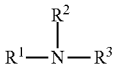

(1)

wherein $R^1$ represents a hydrocarbon group having 4 or more carbon atoms, and $R^2$ and $R^3$ each independently represent a hydrocarbon group having 1 or more and 4 or less carbon atoms.

In the general formula (1), $R^1$ is a hydrocarbon group having 4 or more carbon atoms. The carbon number of $R^1$ is, from the viewpoint of effectively increasing the intermetallic friction coefficient, preferably 8 or more, more preferably 16 or more. From the viewpoint of solubility of the component (A) in the lubricating base oil (E) to be mentioned below, the carbon number is preferably 24 or less, more preferably 20 or less.

In the tertiary amine, preferably, the main component is a tertiary amine where $R^1$ has 8 to 24 carbon atoms, more preferably, the main component is a tertiary amine where $R^1$ has 16 to 20 carbon atoms, and still more preferably, the main component is a tertiary amine where $R^1$ has 18 carbon atoms. The main component means that the content thereof is 50% by mass or more on the basis of the total amount of the tertiary amine, and the content ratio is preferably 80% by mass or more, more preferably 90% by mass or more, still more preferably 100% by mass.

The hydrocarbon group represented by $R^1$ includes an alkyl group, an alkenyl group, an aryl group, an aralkyl group, etc. Among these hydrocarbon groups, a linear, branched or cyclic alkyl group having 16 to 20 carbon atoms, or a linear, branched or cyclic alkenyl group having 16 to 20 carbon atoms is preferred. For enhancing the stability of the tertiary amine and for more lowering the friction coefficient, $R^1$ is preferably an alkyl group. More preferably, $R^1$ is linear.

The alkyl group includes an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group, a tetracosyl group. These may be linear, branched or cyclic.

The alkenyl group includes an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an eicosenyl group, a heneicosenyl group, a docosenyl group, a tricosenyl group, a tetracosenyl group. These may be linear, branched or cyclic, and in these, the double bond may be in any arbitrary position.

Among these, a hexadecyl group, a heptadecyl group, an octadecyl group, a nonadecyl group, an eicosyl group, a heneicosyl group or a docosyl group is preferred; and an octadecyl group such as a stearyl group, etc., an octadecenyl group such as an oleyl group, etc., or an eicosyl group is preferred, and an octadecyl group is most preferred.

In the general formula (1), $R^2$ and $R^3$ each independently represent a hydrocarbon group having 1 or more and 4 or less carbon atoms.

Preferably, $R^2$ and $R^3$ each independently represent a linear, branched or cyclic alkyl group having 1 to 4 carbon atoms, or a linear, branched or cyclic alkenyl group having 1 to 4 carbon atoms. $R^2$ and $R^3$ may be the same as or different from each other. But are preferably the same. When the carbon number of $R^2$ and $R^3$ is 4 or less, the friction coefficient of the lubricating oil composition can be sufficiently lowered. From this viewpoint, the carbon number of $R^2$ and $R^3$ is preferably smaller, and preferably the carbon number is each independently 1 or 2. Further, from the viewpoint of increasing the stability and further lowering the friction coefficient. $R^2$ and $R^3$ each are more preferably an alkyl group.

Specifically, $R^2$ and $R^3$ include a methyl group, an ethyl group, a propyl group, a butyl group, a vinyl group, a propenyl group, a butenyl group, and these may be linear, branched or cyclic. Among these, a methyl group or an ethyl group is preferred, and a methyl group is more preferred.

Specific examples of the component (A) include dimethylhexadecylamine, dimethyloctadecylamine, dimethylheneicosylamine, diethyloctadecylamine, and methylethyloctadecyl amine.

One of them may be used solely or plural kinds thereof may be used in combination as the component (A).

The blending amount of the component (A) is preferably 0.1% by mass or more, more preferably 0.2% by mass or more, still more preferably 0.3% by mass or more on the basis of the total amount of the lubricating oil composition. Also preferably, the blending amount is 2.0% by mass or less, more preferably 1.5% by mass or less, still more preferably 1.0% by mass or less.

The nitrogen content derived from the component (A) is, from the viewpoint of shudder preventive lifetime, preferably 0.005% by mass or more, more preferably 0.010% by mass or more, still more preferably 0.015% by mass or more on the basis of the total amount of the lubricating oil composition. The upper limit thereof is not specifically limited, but when the nitrogen content derived from the component (A) is too large, the effect of prolonging the shudder preventive lifetime is saturated, and therefore, from the viewpoint of an adequate nitrogen content, the nitrogen content derived from the component (A) is preferably 0.100% by mass or less, more preferably 0.075% by mass or less, still more preferably 0.050% by mass or less on the basis of the total amount of the lubricating oil composition.

<Component (B): Metal-Based Detergent Having a Total Base Number According to a Perchloric Acid Method of 50 mgKOH/g or Less>

The component (B) for use in the present invention is a metal-based detergent having a total base number according to a perchloric acid method of 50 mgKOH/g or less (hereinafter this may be referred to as "low-basic metal-based detergent").

Here, the total base number according to a perchloric acid method is a total base number measured according to the perchloric acid method described in JIS K2501:2003. (Hereinafter this may be referred to as "TBN".)

The lubricating oil composition contains the component (B) and the component (C) to be mentioned below, and therefore has a high intermetallic friction coefficient and has a prolonged shudder preventive lifetime. From these viewpoints, TBN of the component (B) is preferably 40 mgKOH/g or less, more preferably 30 mgKOH/g or less, still more preferably 20 mgKOH/g or less. From the viewpoint that the lubricating oil composition can have a high intermetallic friction coefficient, the value is preferably 10 mgKOH/g or more.

The component (B) is preferably at least one low-basic metal-based detergent selected from an alkaline earth metal sulfonate, an alkaline earth metal phenate and an alkaline earth metal salicylate. The alkaline earth metal includes magnesium, calcium and barium and is preferably one or more selected from magnesium and calcium. From the viewpoint of satisfying both high intermetallic friction coefficient and prolonged shudder lifetime, calcium is more preferred.

The alkaline earth metal sulfonate is preferably an alkaline earth metal salt of an alkylaromatic sulfonic acid to be obtained by sulfonating an alkylaromatic compound having a mass average molecular weight of 300 or more and 1,500 or less, more preferably 400 or more and 700 or less, for example, a magnesium salt or an calcium salt thereof, and a calcium salt is preferred.

Examples of the sulfonic acid to be used in the alkaline earth metal sulfonate include an aromatic petroleum sulfonic acid, an alkylsulfonic acid, an arylsulfonic acid, an alkylarylsulfonic acid, etc., and specifically, examples thereof include dodecylbenzenesulfonic acid, dilaurylcetylbenzenesulfonic acid, paraffin wax-substituted benzenesulfonic acid, polyolefin-substituted benzenesulfonic acid, polyisobutylene-substituted benzenesulfonic acid, naphthalenesulfonic acid, etc.

The alkaline earth metal phenate includes an alkaline earth metal salt of an alkylphenol, an alkylphenol sulfide or an alkylphenol Mannich reaction product, and examples thereof include a magnesium salt and a calcium salt thereof, and a calcium salt thereof is preferred.

The alkaline earth metal salicylate includes an alkaline earth metal salt of an alkylsalicylic acid, and examples thereof include a magnesium salt and a calcium salt thereof, and a calcium salt thereof is preferred.

The component (B) preferably has a linear alkyl group or a branched alkyl group in the structure thereof, in which the carbon number of the alkyl group is preferably 4 or more and 30 or less, more preferably 6 or more and 18 or less.

Regarding the method for obtaining the low-basic alkaline earth metal sulfonate, the low-basic alkaline earth metal phenate and the low-basic alkaline earth metal salicylate as the component (B), for example, the above-mentioned alkylaromatic sulfonic acid, alkylphenol, alkylphenol sulfide, alkylphenol Mannich reaction product or alkylsalicylic acid may be directly reacted with an alkaline earth metal base such as an oxide or hydroxide of one or more kinds of alkaline earth metals selected from magnesium and calcium, or the former may be once converted into an alkali metal salt such as a sodium salt or a potassium salt thereof and then substituted with an alkaline earth metal salt to give a neutral alkaline earth metal sulfonate, a neutral alkaline earth metal phenate and a neutral alkaline earth metal salicylate to be contained in the component; and further, for example, the neutral alkaline earth metal sulfonate, the neutral alkaline earth metal phenate or the neutral alkaline earth metal salicylate may be heated along with an alkaline earth metal salt or an alkaline earth metal base in an excessive amount to satisfy the above-mentioned TBN range in the presence of water to obtain the intended component.

One of them may be used solely or plural kinds thereof may be used in combination as the component (B).

From the viewpoint of prolonging the shudder preventive lifetime of the lubricating oil composition, the blending amount of the component (B) as the metal-equivalent amount thereof is preferably 0.001% by mass or more, more preferably 0.002% by mass or more on the basis of the total amount of the lubricating oil composition. When the blending amount of the component (B) is too large, the effect of prolonging shudder preventive lifetime is saturated, and therefore, from the viewpoint of an adequate level, the blending amount as the metal-equivalent amount thereof is preferably 0.03% by mass or less, more preferably 0.02% by mass or on the basis of the total amount of the lubricating oil composition.

<Component (C): Metal-Based Detergent Having a Total Base Number According to a Perchloric Acid Method of 150 mgKOH/g or More>

The component (C) for use in the present invention is a metal-based detergent having a total base number according to a perchloric acid method of 150 mgKOH/g or more (hereinafter this may be referred to as "overbased metal-based detergent").

The lubricating oil composition contains the component (C) and the component (B), and therefore can have a high intermetallic friction coefficient and can have a prolonged shudder preventive lifetime. From this viewpoint, TBN of the component (C) is preferably 200 mgKOH/g or more, more preferably 250 mgKOH/g or more, still more preferably 300 mgKOH/g or more. In addition, from the viewpoint that the lubricating oil composition can have a more prolonged shudder preventive life time, the value is preferably 600 mgKOH/g or less, more preferably 500 mgKOH/g or less.

The component (C) is preferably at least one overbased metal-based detergent selected from an alkaline earth metal sulfonate, an alkaline earth metal phenate and an alkaline earth metal salicylate. The alkaline earth metal includes magnesium, calcium and barium, and is preferably one or more selected from magnesium and calcium, and from the viewpoint of satisfying both a high intermetallic friction coefficient and a prolonged shudder lifetime, calcium is more preferred.

The alkaline earth metal sulfonate, the alkaline earth metal phenate and the alkaline earth metal salicylate are the same as those described for the component (B), and preferred examples thereof are also the same as those for the latter.

The component (C) preferably has a linear alkyl group or a branched alkyl group in the structure thereof, and the carbon number of the alkyl group is preferably 4 or more and 30 or less, more preferably 6 or more and 18 or less.

One example of the method for obtaining the overbased alkaline earth metal sulfonate, the overbased alkaline earth metal phenate and the overbased alkaline earth metal salicylate as the component (C) is a method of reacting a neutral alkaline earth metal sulfonate, a neutral alkaline earth metal phenate or a neutral alkaline earth metal salicylate with an alkaline earth metal carbonate or borate in the presence of carbon dioxide gas.

One of them may be used solely or plural kinds thereof may be used in combination as the component (C).

From the viewpoint of increasing the intermetallic friction coefficient of the lubricating oil composition, the blending amount of the component (C) as the metal-equivalent amount thereof is preferably 0.01% by mass or more, more preferably 0.015% by mass or more on the basis of the total amount of the lubricating oil composition. When the blending amount of the component (C) is too large, the effect of increasing the intermetallic friction coefficient is saturated, and therefore, from the viewpoint of an adequate level, the blending amount as the metal-equivalent amount thereof is preferably 0.10% by mass or less, more preferably 0.08% by mass or less on the basis of the total amount of the lubricating oil composition.

The total blending amount of the component (B) and the component (C) as the total metal-equivalent amount of the metal fraction derived from the component (B) and the component (C) is preferably 0.01% by mass or more, more preferably 0.015% by mass or more on the basis of the total amount of the lubricating oil composition. Also preferably, the amount is 0.13% by mass or less, more preferably 0.10% by mass or less on the basis of the total amount of the lubricating oil composition.

As described above, the mass ratio of the metal fraction derived from the component (B) to the metal fraction derived from the component (C), (B/C) must be 0.60 or less. When the mass ratio is 0.60 or less, the lubricating oil composition can have a high intermetallic friction coefficient and a prolonged shudder preventive lifetime.

By combining the components (A), (C) and (D) for use in the present invention, the composition can have a high intermetallic friction coefficient and a long shudder preventive lifetime; and by further combining the component (B), these characteristics can be improved more. Here, when the long shudder preventive life time and the high intermetallic friction coefficient are intended to be further increased by additionally combining the component (B), these characteristics are in trade-off. However, in the lubricating oil composition, the mass ratio (B/C) is defined to be 0.60 or less, and therefore, the composition can exhibit an excellent effect of satisfying both the high intermetallic friction coefficient and the long shudder preventive lifetime although these characteristics are in a relation of trade-off. As a result, by combining the components (A) to (D) for use in the present invention, an excellent synergetic effect can be realized.

<Component (D): At Least One Selected from an Acidic Phosphate and an Acidic Phosphite>

The component (D) for use in the present invention is at least one selected from an acidic phosphate and an acidic phosphite.

The lubricating oil composition can have a high intermetallic friction coefficient as blended with the component (D). For example, the component (D) is preferably an acidic phosphate represented by the following general formula (2) or (3), or an acidic phosphite represented by the following general formula (4) or (5).

When the component (D) is blended therein, as described above, the composition can have a high intermetallic friction coefficient and a long shudder preventive lifetime owing to the interaction with the component (A) and the component (C).

(2)

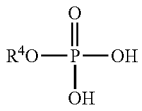

(3)

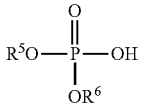

(4)

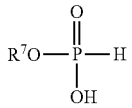

(5)

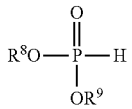

In the general formulae (2) or (3), and (4) or (5), $R^4$ to $R^9$ each represent a hydrocarbon group, and are independently preferably a hydrocarbon having 12 or less carbon atoms, more preferably a hydrocarbon having 8 or less carbon atoms. When the carbon number is 12 or less, the lubricating oil composition can have a higher intermetallic friction coefficient.

Examples of the hydrocarbon group having 12 or less carbon atoms include an alkyl group having 12 or less carbon atoms, an alkenyl group having 12 or less carbon atoms, an aryl group having 6 or more and 12 or less carbon atoms, and an aralkyl group having 7 or more and 12 or less carbon atoms. The alkyl group and the alkenyl group may be linear, branched or cyclic, and examples thereof include a methyl group, an ethyl group, an n-propyl group, an isopropyl group, an n-butyl group, an isobutyl group, a sec-butyl group, a tert-butyl group, various types of pentyl groups, various types of hexyl groups, various types of heptyl groups, various types of octyl group, various types of nonyl groups, various types of decyl groups, various types of dodecyl groups, a cyclopentyl group, a cyclohexyl group, an allyl group, a propenyl group, various types of butenyl groups, various types of hexenyl groups, various types of octenyl groups a cyclopentenyl group, and a cyclohexenyl group.

Examples of the aryl group having 6 or more and 12 or less carbon atoms include a phenyl group, a tolyl group, and a xylyl group; examples of the aralkyl group having 7 or more and 12 or less carbon atoms include a benzyl group, a phenethyl group, a methylbenzyl group, an ethylbenzyl group, a propylbenzyl group, a butylbenzyl group and a hexylbenzyl group.

Examples of the acidic phosphate monoester represented by the above general formula (2) include monoethyl acid phosphate, mono-n-propyl acid phosphate, mono-n-butyl acid phosphate, and mono-2-ethylhexyl acid phosphate.

Examples of the acidic phosphate diester represented by the above general formula (3) include diethyl acid phosphate, di-n-propyl acid phosphate, di-n-butyl acid phosphate and di-2-ethylhexyl acid phosphate.

Examples of the acidic phosphite monoester represented by the above general formula (4) include monoethyl hydrogenphosphite, mono-n-propyl hydrogenphosphite, mono-n-butyl hydrogenphosphite and mono-2-ethylhexyl hydrogenphosphite.

Examples of the acidic phosphite diester represented by the above general formula (5) include dihexyl hydrogenphosphite, diheptyl hydrogenphosphite, di-n-octyl hydrogenphosphite, and di-2-ethylhexyl hydrogenphosphite.

Among the above-mentioned acidic phosphite diesters, an acidic phosphite diester having an alkyl group with 6 or more and 8 or less carbon atoms is preferred from the viewpoint of realizing a higher intermetallic friction coefficient, an acidic phosphite diester having a branched alkyl group is more preferred, and an acidic phosphite diester having a branched alkyl group with 8 carbon atoms is still more preferred.

One of them may be used solely or plural kinds thereof may be used in combination as the component (D).

The phosphorus amount derived from the component (D) is preferably 0.01% by mass or more, more preferably 0.02% by mass or more, and is preferably 0.09% by mass or less on the basis of the total amount of the lubricating oil composition. When the blending amount of the component (D) is defined to be 0.01% by mass or more on the basis of the total amount of the lubricating oil composition, the intermetallic friction coefficient can be increased.

<Component (E): Lubricating Base Oil>

Not specifically limited, the lubricating base oil for use in the present invention may be adequately selected from mineral oils and synthetic oils heretofore used as a base oil for lubricating oil.

Regarding mineral oils, for example, there are mentioned a mineral oil purified by treating a lubricanting oil fraction obtained through reduced-pressure distillation of an atmospheric residue obtained by atmospheric distillation of a crude oil, through one or more treatments of solvent deasphalting, solvent extraction, hydrocracking, solvent dewaxing, catalytic dewaxing, hydrorefining and the like, and a base oil produced by isomerizing wax or GTL wax (gas-to-liquid wax). Among these, a mineral oil treated through hydrorefining is preferred. The mineral oil treated through hydrorefining readily make a % $C_P$ and a viscosity index as mentioned later good.

Examples of the synthetic oils include poly-α-olefins such as polybutenes, α-olefin homopolymers and copolymers (e.g., ethylene-α-olefin copolymers), etc.; various esters such as polyol esters, dibasic acid esters, phosphates, etc.; various ethers such as polyphenyl ethers, etc.; polyglycols, alkylbenzenes, alkylnaphthalenes, etc. Among these synthetic oils, in particular, poly-α-olefins and esters are preferred, and a combination of two kinds of these is also suitably used as a synthetic oil.

In one aspect of the present invention, one alone of the above-mentioned mineral oils may be used as the lubricating base oil, or two or more of them may be used. Also, one alone of the above-mentioned synthetic oils may be used, or two or more of them may be used. Further, a combination of one or more mineral oils and one or more synthetic oils may be used.

Preferably, the component (E) has a kinematic viscosity at 100° C. of 1.0 $mm^2/s$ or more, more preferably 1.5 $mm^2/s$ or more, still more preferably 1.7 $mm^2/s$ and yet still more preferably 2.0 $mm^2/s$ or more. Also preferably, the kinematic viscosity is 10.0 $mm^2/s$ or less, more preferably 7.0 $mm^2/s$ or less, still more preferably 6.5 $mm^2/s$ or less, yet still more preferably 5.0 $mm^2/s$ or less.

When the kinematic viscosity is 10.0 $mm^2/s$ or less, deterioration of a low-temperature viscosity of the lubricating oil composition can be prevented, and when the kinematic viscosity is 1.0 $mm^2/s$ or more, the lubricating oil composition is free from a problem of oil film shortage or oil film formation failure to increase the friction around the sliding parts of devices.

The value of the kinematic viscosity is measured according to the method described in the section of Examples to be given below.

The component (E) is preferably composed of the following components (E1) and (E2).

(Component E1)

The component (E1) is a lubricating base oil whose kinematic viscosity at 100° C. falls within a range of 1.0 $mm^2/s$ or more and 5.0 $mm^2/s$ or less. When the kinematic viscosity is 5.0 $mm^2/s$ or less, the low-temperature viscosity of the lubricating oil composition can be prevented from increasing, and when the kinematic viscosity is 1.0 $mm^2/s$ or more, the lubricating oil composition is free from a problem of oil film shortage or oil film formation failure to increase the friction around the sliding parts of devices. From these viewpoints, the kinematic viscosity at 100° C. of the component (E1) is preferably 1.2 $mm^2/s$ or more, more preferably 1.3 $mm^2/s$ or more, still more preferably 1.5 $mm^2/s$ or more. Also preferably, the kinematic viscosity is 4.5 $mm^2/s$ or less, more preferably 4.0 $mm^2/s$ or less, still more preferably 3.0 $mm^2/s$ or less.

The value of the kinematic viscosity is measured according to the method described in the section of Examples to be given below.

(Component E2)

The component (E2) is a lubricating base oil whose kinematic viscosity at 100° C. falls within a range of 50 $mm^2/s$ or more and 1,000 $mm^2/s$ or less. When the kinematic viscosity is 1,000 $mm^2/s$ or less, the kinematic viscosity of the component (E) can be prevented from being too high and deterioration of the low-temperature viscosity of the lubricating oil composition can be prevented. When the kinematic viscosity is 50 $mm^2/s$ or more, the viscosity index of the lubricating oil composition can be high to exhibit sufficient fuel saving performance.

From these viewpoints, the kinematic viscosity at 100° C. of the component (E2) is preferably 60 $mm^2/s$ or more, more preferably 90 $mm^2/s$ or more, still more preferably 120 $mm^2/s$ or more. Also preferably, the kinematic viscosity is 500 $mm^2/s$ or less, more preferably 400 $mm^2/s$ or less, still more preferably 200 $mm^2/s$ or less.

The value of the kinematic viscosity is measured according to the method described in the section of Examples to be given below.

As the (E2) component, a poly α-olefin (PAO) such as an α-olefin copolymer synthesized with a metallocene catalyst (e.g., an ethylene-α-olefin copolymer) is preferable.

From the viewpoint that the lubricating oil composition can have an adequate kinematic viscosity at 100° C., the content of the component (E2) is preferably 5% by mass or more, more preferably 10% by mass or more, and is preferably 20% by mass or less on the basis of the total amount of the lubricating oil composition.

Though not specifically limited, the kinematic viscosity at 40° C. of the component (E) is preferably 5 to 65 $mm^2/s$, more preferably 8 to 40 $mm^2/s$, still more preferably 10 to 25 $mm^2/s$.

The viscosity index of the component (E) is preferably 70 or more, more preferably 90 or more, still more preferably 100 or more, yet still more preferably 120 or more. The base oil having a viscosity index of 70 or more has a small viscosity change with a temperature change.

When the viscosity index of the component (E) falls within the range, the viscosity characteristics of the lubricating oil composition can be readily bettered. The viscosity index is an index to be measured according to the method described in the section of Examples given below.

In the lubricating oil composition of one aspect of the present invention, the amount of the lubricating base oil to be contained is generally 70% by mass or more, preferably 70 to 97% by mass, more preferably 70 to 95% by mass on the basis of the total amount of the lubricating oil composition.

<Other Components>

The lubricating oil composition of one aspect of the present invention may contain any other components than the above-mentioned components (A) to (E) within a range not detracting from the advantageous effects of the present invention. Examples of the other components include additives generally used in lubricating oil, such as a viscosity index improver, a pour point depressant, an anti-wear agent, a friction modifier, an ash-free dispersant, a rust inhibitor, a metal deactivator, an anti-foaming agent, an antioxidant, etc.

Examples of the viscosity index improver include polymethacrylates (PMA) (e.g., polyalkyl methacrylates, polyalkyl acrylates, etc.), olefinic copolymers (OCP) (e.g., ethylene-propylene copolymers (EPC), polybutylenes, etc.), styrenic copolymers (e.g., polyalkylstyrenes, styrene-diene copolymers, styrene-isoprene copolymers, styrene-diene hydrogenated copolymers, styrene-maleic anhydride ester copolymers, etc.), etc. The PMA viscosity index improvers include dispersive ones and non-dispersive ones. The dispersive PMA viscosity improvers are alkyl methacrylate or alkyl acrylate homopolymers, and the non-dispersive PMA viscosity index improvers are copolymers of an alkyl methacrylate or alkyl acrylate and a dispersive polar monomer (e.g., diethylaminoethyl methacrylate, etc.). Like the PMA viscosity index improver, the OCP viscosity index improvers include dispersive ones and non-dispersive ones.

The mass average molecular weight (Mw) of the viscosity index improver is generally 5,000 to 1,000,000, and that of the PMA viscosity index improver is preferably 20,000 or more, more preferably 25,000 or more, and is preferably 300,000 or less, more preferably 250,000 or less, still more preferably 200,000 or less. The mass average molecular weight of the OCP viscosity index improver is preferably 5,000 or more, more preferably 10,000 or more, and is preferably 800,000 or less, more preferably 500,000 or less.

The mass average molecular weight (Mw) is measured according to the method described in the section of Examples to be given below.

One of these viscosity index improvers may be used solely or two or more kinds thereof may be used in combination. From the viewpoint of viscosity index improvement, the amount thereof to be incorporated is preferably 0.5% by mass or more, more preferably 1.0% by mass or more, and is preferably 15% by mass or less, more preferably 10% by mass or less, still more preferably 9.5% by mass or less on the basis of the total amount of the lubricating oil composition.

Examples of the pour point depressant include ethylene-vinyl acetate copolymers, chloroparaffin-naphthalene condensates, chloroparaffin-phenol condensates, polymethacrylates (PMA) (polyalkyl methacrylates, polyalkyl acrylates, etc.), polyalkylstyrenes, polyvinyl acetates, polybutenes, etc. PMA are preferred. The PMA pour point depressant has the same chemical structure as that of the above-mentioned PMA viscosity index improver. Regarding the pour point depressing action thereof, the side-chain alkyl group that bonds as an ester to the main chain of PMA co-crystallizes with the wax fraction of the lubricating base oil to control the crystal growth orientation to thereby change the crystal morphology of wax to lower the pour point. The mass average molecular weight of the PMA pour point depressant is, for example, 10,000 or more and 150,000 or less.

One of these pour point depressants may be used solely or two or more kinds thereof may be used in combination. The blending amount thereof is preferably 0.01% by mass or more, more preferably 0.10% by mass or more, and is preferably 10% by mass or less, more preferably 5.0% by mass or less, still more preferably 1.0% by mass or less on the basis of the total amount of the lubricating oil composition.

Examples of the anti-wear agent include sulfur-containing anti-wear agents such as metal thiophosphates (examples of metal: zinc (Zn), lead (Pb), antimony (Sb)) and metal thiocarbamates (examples of metal: zinc (Zn)), and phosphorus-containing anti-wear agents such as phosphates (e.g., tricresyl phosphate). One of these anti-wear agents may be used solely or two or more kinds thereof may be used in combination. The blending amount of the anti-wear agent is preferably within a range of 0.05% by mass or more and 5.0% by mass or less on the basis of the total amount of the lubricating oil composition.

Examples of the friction modifier include polyalcohol partial esters such as neopentyl glycol monolaurate, trimethylolpropane monolaurate, glycerin monooleate (namely, oleic acid monoglyceride), etc. One of these friction modifiers may be used solely or two or more kinds thereof may be used in combination arbitrarily. The blending amount of the friction modifier is preferably within a range of 0.05% by mass or more and 4% by mass or less on the basis of the total amount of the lubricating oil composition.

Examples of the ash-free dispersant include succinimides, boron-containing succinimides, benzylamines, boron-containing benzylamines, succinates, amides of mono- or dicarboxylic acids as typified by fatty acid or succinic acid, etc.

Specifically, for example, there are mentioned polybutenylsuccinimides (polybutenylsuccinic monoimides, polybutenylsuccinic bisimides, etc.) having a polybutenyl group having a number average molecular weight (Mn) of 900 to 3,500, polybutenylbenzylamines, polybutenylamines, and derivatives thereof such as boric acid-modified derivatives thereof (polybutenylsuccinic monoimide borides, etc.), etc. One of these ash-free dispersants may be used solely or two or more kinds thereof may be used in combination.

The blending amount of the ash-free dispersant is preferably within a range of 0.10% by mass or more and 20% by mass or less on the basis of the total amount of the lubricating oil composition, more preferably 1.0% by mass or more and 10% by mass or less.

Examples of the rust inhibitor include alkyl or alkenylsuccinic acid derivatives such as dodecenylsuccinic half esters, octadecenylsuccinic anhydrides, dodecenylsuccinamides, etc.; fatty acid soaps; alkylsulfonates; polyalcohol partial esters such as sorbitan monooleate, glycerin monooleate, pentaerythritol monooleate, etc.; amines such as rosin amines, N-oleylsarcosines, etc.; dialkylphosphite amine salts; fatty acid amides; paraffin oxides; alkyl polyoxyethers, etc. One of these rust inhibitors may be used solely or two or more kinds thereof may be used in combination.

The blending amount of the rust inhibitor is preferably within a range of 0.01% by mass or more and 3.0% by mass or less on the basis of the total amount of the lubricating oil composition.

Examples of the metal deactivators (examples of metal: copper, iron) include benzotriazoles, triazole derivatives, benzotriazole derivatives, thiadiazole derivatives. One of the metal deactivators may be used solely or two or more kinds thereof may be used in combination.

The blending amount of the metal deactivator is preferably within a range of 0.01% by mass or more and 5.0% by mass or less on the basis of the total amount of the lubricating oil composition.

Examples of the anti-foaming agent include silicone compounds such as dimethylpolysiloxanes, etc.; ester compounds such as polyacrylates, etc. One of the anti-foaming agents may be used solely or two or more kinds thereof may be used in combination.

The blending amount of the anti-foaming agent is preferably within a range of 0.05% by mass or more and 5.0% by mass or less on the basis of the total amount of the lubricating oil composition.

As the antioxidant, hindered phenol-type ones or amine-type ones, as well as zinc alkyldithiophosphates (ZnDTP) and the like are preferably used. As the hindered phenol-type antioxidants, bisphenol-type or ester group-containing phenol-type ones are preferred. As the amine-type antioxidants, dialkyldiphenylamine-type or naphthylamine-type ones are preferred. One of the antioxidants may be used solely or two or more kinds thereof may be used in combination.

The blending amount of the antioxidant is preferably within a range of 0.05% by mass or more and 7.0% by mass or less on the basis of the total amount of the lubricating oil composition.

<Properties of Lubricating Oil Composition>

The kinematic viscosity at 100° C. (hereinafter this may be referred to as "100° C. kinematic viscosity") of the lubricating oil composition is preferably 10.0 $mm^2/s$ or less. When the 100° C. kinematic viscosity falls within the range, the energy loss in driving a transmission can be reduced to realize fuel saving. From this viewpoint, the 100° C. kinematic viscosity is more preferably 8.0 $mm^2/s$ or less, still more preferably 7.0 $mm^2/s$ or less, yet still more preferably 6.5 $mm^2/s$ or less. From the viewpoint of forming a sufficient oil film on a slide surface to reduce wear of devices owing to oil film formation failure, the 100° C. kinematic viscosity is preferably 1.0 $mm^2/s$ or more, more preferably 1.5 $mm^2/s$ or more, still more preferably 2.0 $mm^2/s$ or more.

The value of the 100° C. kinematic viscosity is measured according to the method described in the section of Examples to be given below.

The viscosity index (VI) of the lubricating oil composition is preferably 175 or more. When the viscosity index (VI) falls within the range, the viscosity change of the lubricating oil composition with a temperature change is small and therefore the lubricating oil composition can keep a desired low viscosity not only in a high-temperature range but also in an ordinary-temperature range while maintaining the high-temperature viscosity thereof to be on an adequate level. Consequently, the energy loss in driving a transmission can be stably reduced in a broad service temperature range to realize fuel saving. From this viewpoint, the viscosity index (VI) is more preferably 185 or more, still more preferably 195 or more.

The value of the viscosity index (VI) is measured according to the method described in the section of Examples to be given below.

The Brookfield (BF) viscosity at −40° C. (hereinafter this may be referred to as "low-temperature viscosity") of the lubricating oil composition is preferably 10,000 mPa·s or less. When the low-temperature viscosity falls within the range, the composition can keep a low viscosity even in an extremely low temperature range, and therefore the energy loss in driving a transmission can be stably reduced in a broad service temperature range to realize fuel saving. From this viewpoint, the low-temperature viscosity is more preferably 8,000 mPa·s or less, still more preferably 6,000 mPa·s or less.

The value of the low-temperature viscosity is measured according to the method described in the section of Examples to be given below.

The intermetallic friction coefficient of the lubricating oil composition is preferably 0.110 or more, more preferably 0.113 or more, still more preferably 0.115 or more. The value of the intermetallic friction coefficient is measured according to the method described in the section of Examples to be given below.

The clutch shudder preventive lifetime (hereinafter this may be referred to as "shudder preventive lifetime") of the lubricating oil composition is preferably 380 hours or more, more preferably 400 hours or more, still more preferably 450 hours or more. The value of the shudder preventive life time is measured according to the method described in the section of Examples to be given below.

[Production Method for Lubricating Oil Composition]

The production method for the lubricating oil composition of the present invention is not specifically limited. The above-mentioned components (A) to (E) may be blended to produce the lubricating oil composition. For example, the components (A) to (D) may be added to the lubricating base oil (E) to produce the lubricating oil composition. In the production method for the lubricating oil composition of one aspect of the present invention, any other components than the components (A) to (E) may be blended in.

The components (A) to (E) and other components may be the same as above, and the lubricating oil composition to be obtained according to the production method for the lubricating oil composition is as described above, and the description thereof is omitted here.

In the present production method, the components (A) to (E) and other components may be blended in any manner, and the blending method is not limited.

[Use of Lubricating Oil Composition]

The lubricating oil composition of the present invention is suitably used, for example, for automobile transmissions and other transmissions. The other transmissions include manual transmissions, etc. The lubricating oil composition of the present invention is more suitable for metal belt-type or chain-type continuously-variable transmissions and also for stepped automatic transmissions.

EXAMPLES

The present invention is described in more detail by reference to Examples, but it should be construed that the present invention is by no means limited by these Examples.

In this description, the properties of the raw materials used in Examples and Comparative Examples were measured according to the protocols mentioned below.

(1) Kinematic Viscosity

This is a value measured according to JIS K2283:2000.

(2) Viscosity Index

This is a value measured according to JIS K2283:2000.

(3) Ring Analysis (% $C_A$ and % $C_P$)

The proportion (percentage) of the aromatic fraction referred to as % $C_A$, and the proportion (percentage) of the paraffin fraction referred to as % $C_P$ were calculated through ring analysis of an n-d-M method according to ASTM D-3238-95.

(4) Nitrogen Content

This was measured according to JIS K2609:1998.

(5) Total Base Number

This is a value measured according to a perchloric acid method according to JIS K2501:2003.

(6) Calcium Amount

This is a value measured according to JPI-5S-38-92.

(7) Phosphorus Amount

This is a value measured according to JPI-5S-38-92.

(8) Mass Average Molecular Weight (Mw) of Poly(meth) acrylate

The mass average molecular weight (Mw) is a value measured under the following condition based on a calibration curve of polystyrene. Precisely, the value was measured under the following condition.

Apparatus: "1260 Infinity" (product name, manufactured by Agilent Technologies Corporation)

Columns: "GPC LF404" (product name, manufactured by Shodex Co., Ltd.)×2

Solvent: Chloroform

Temperature: 40° C.

Sample Concentration: 0.5% by mass

Calibration Curve: Polystyrene

Detector: Differential Refractometer Detector

The evaluation methods for the lubricating oil composition of Examples and Comparative Examples are as mentioned below.

The lubricating oil composition was analyzed for elemental content therein.

[Nitrogen Content]

This was measured according to JIS K2609:1998.

[Calcium Content, Phosphorus Content]

The total content of calcium (Ca) and the total content of phosphorus (P) were measured according to JPI-5S-38-92.

[Mass Ratio of Calcium Content Derived from Component (B) and Component (C) (B/C)]

This was calculated based on the blending amount ratio of the component (B) and the component (C).

The properties of the lubricating oil composition were evaluated according to the following methods.

[100° C. Kinematic Viscosity]

The 100° C. kinematic viscosity was measured according to JIS K2283:2000.

[Viscosity Index (VI)]

The viscosity index was measured according to JIS K2283:2000.

[Brookfield (BF) Viscosity at −40° C. (Low-Temperature Viscosity)]

The Brookfield viscosity at −40° C. was measured according to ASTM D2983-09.

The characteristics of the lubricating oil composition were evaluated according to the following methods.

[Intermetallic Friction Coefficient: LFW-1 Test]

Using a block-on-ring tester (LFW-1) described in ASTM D2714-94, the intermetallic friction coefficient was measured. Concrete test conditions are as follows.

Test Tool:

Ring: Falex S-10 Test Ring (SAE4620 Steel)

Block: Falex 11-60 Test Block (SAE01 Steel)

Test Condition:

Oil temperature: 110° C.

Load: 1,112 N

Sliding speed: 1.0 m/s (Running-in period condition: oil temperature: 110° C., load: 1,112 N, sliding speed: 1.0 m/s, time: 30 min)

[Clutch Shudder Preventive Lifetime]

The lifetime was evaluated according to JASO M349-2012. Concrete test conditions are as follows.

Friction material: cellulosic disc/steel plate

Oil amount: 150 mL

Oil temperature: 120° C.

Sliding speed: 0.9 m/s

Sliding time: 30 min

Downtime: 1 min

Performance measurement: At intervals of 24 hours after the start of the test, the μ-V characteristic was measured, and the time until when the value of dμ/dV at 80° C. becomes less than 0 was measured to be the clutch shudder preventive lifetime.

(Running-in period condition: oil temperature: 80° C., surface pressure: 1 MPa, sliding speed: 0.6 m/s, time: 30 min)

Examples 1 to 6, and Comparative Examples 1 to 5

Lubricating oil compositions were prepared, each having a blending formulation shown in the following Tables 1 and 2. According to the evaluation methods mentioned above, the lubricating oil compositions of Examples and Comparative Examples were evaluated. The obtained results are shown in the following Table 1 and Table 2.

TABLE 1

| | | | Unit | Example 1 | Example 2 | Example 3 | Example 4 | Example 5 | Example 6 |
|---|---|---|---|---|---|---|---|---|---|
| Blending Formulation | Component (E) | Lubricating base oil (1) | mass % | balance | balance | balance | balance | balance | balance |
| | | Lubricating base oil (2) | mass % | 15.10 | 14.50 | — | 15.10 | 15.10 | 15.10 |
| | | Lubricating base oil (3) | mass % | — | — | — | — | — | — |
| | Component (A) | Dimethyloctadecylamine | mass % | 0.40 | 0.40 | 0.40 | 0.40 | 0.40 | 0.40 |
| | Component (B) | Low-basic calcium sulfonate | mass % | 0.40 | 0.40 | 0.40 | 0.40 | 0.40 | 0.40 |
| | Component (C) | Overbased calcium sulfonate (1) | mass % | — | — | — | 0.30 | — | — |
| | | Overbased calcium sulfonate (2) | mass % | 0.30 | 0.30 | 0.30 | — | 0.20 | 0.10 |
| | Component (D) | 2-Ethylhexyl hydrogenphosphite | mass % | 0.25 | 0.25 | 0.25 | 0.25 | — | — |
| | | 2-Ethylhexyl acid phosphate | mass % | — | — | — | — | 0.25 | 0.25 |
| | Others | Viscosity index improver (1) | mass % | 6.00 | 9.00 | — | 6.00 | 6.00 | 6.00 |
| | | Viscosity index improver (2) | mass % | — | — | 8.30 | — | — | — |
| | | Pour point depressant | mass % | 0.20 | 0.20 | 0.20 | 0.20 | 0.20 | 0.20 |
| | | Oleylamine | mass % | — | — | — | — | — | — |
| | | Tricresyl phosphate | mass % | 0.30 | 0.30 | 0.30 | 0.30 | 0.30 | 0.30 |
| | | Oleic acid monoglyceride | mass % | 0.25 | 0.25 | 0.25 | 0.25 | 0.25 | 0.25 |
| | | Polybutenylsuccinimide | mass % | 3.00 | 3.00 | 3.00 | 3.00 | 3.00 | 3.00 |
| | | Sulfur-containing anti-wear agent | mass % | 0.50 | 0.50 | 0.50 | 0.50 | 0.50 | 0.50 |
| | | Copper deactivator | mass % | 0.05 | 0.05 | 0.05 | 0.05 | 0.05 | 0.05 |
| | | Anti-foaming agent | mass % | 0.20 | 0.20 | 0.20 | 0.20 | 0.20 | 0.20 |
| | | Total | mass % | 100.00 | 100.00 | 100.00 | 100.00 | 100.00 | 100.00 |
| Base Oil Properties | | Kinematic viscosity of component (E) (100° C.) | $mm^2/s$ | 4.2 | 4.2 | 2.2 | 4.2 | 4.2 | 4.2 |
| Lubricating Oil Properties | Elements in Lubricating Oil | Nitrogen amount | mass % | 0.15 | 0.15 | 0.15 | 0.15 | 0.15 | 0.15 |
| | | Nitrogen amount derived from component (A) | mass % | 0.02 | 0.02 | 0.02 | 0.02 | 0.02 | 0.02 |
| | | Calcium amount derived from components (B) and (C) | mass % | 0.05 | 0.05 | 0.05 | 0.05 | 0.04 | 0.03 |
| | | Calcium amount ratio, (B)/(C) | — | 0.21 | 0.21 | 0.21 | 0.21 | 0.24 | 0.50 |
| | | Phosphorus amount | mass % | 0.05 | 0.05 | 0.05 | 0.05 | 0.05 | 0.05 |
| | | Phosphorus amount derived from component (D) | mass % | 0.03 | 0.03 | 0.03 | 0.03 | 0.03 | 0.03 |
| | General Properties | Kinematic viscosity (100° C.) | $mm^2/s$ | 6.1 | 7.1 | 4.2 | 6.1 | 6.1 | 6.1 |
| | | Viscosity index (VI) | — | 210 | 216 | 255 | 210 | 210 | 210 |
| | | Low-temperature viscosity (−40° C. BF viscosity) | mPa · s | 4200 | 6000 | 1300 | 4200 | 4100 | 4100 |
| | Evaluation Results | LFW-1 intermetallic friction coefficient | — | 0.122 | 0.122 | 0.122 | 0.122 | 0.122 | 0.118 |
| | | Clutch shudder preventive lifetime | h | 482 | 495 | 480 | 495 | 501 | 538 |

TABLE 2

| | | | Unit | Comparative Example 1 | Comparative Example 2 | Comparative Example 3 | Comparative Example 4 | Comparative Example 5 |
|---|---|---|---|---|---|---|---|---|
| Blending Formulation | Component (E) | Lubricating base oil (1) | mass % | — | — | — | — | — |
| | | Lubricating base oil (2) | mass % | — | — | — | — | — |
| | | Lubricating base oil (3) | mass % | balance | balance | balance | balance | balance |
| | Component (A) | Dimethyloctadecylamine | mass % | 0.40 | 0.40 | — | 0.40 | 0.40 |
| | Component (B) | Low-basic calcium sulfonate | mass % | 0.90 | — | — | — | — |
| | Component (C) | Overbased calcium sulfonate (1) | mass % | — | — | — | — | — |

TABLE 2-continued

| | | | Unit | Comparative Example 1 | Comparative Example 2 | Comparative Example 3 | Comparative Example 4 | Comparative Example 5 |
|---|---|---|---|---|---|---|---|---|
| | | Overbased calcium sulfonate (2) | mass % | 0.20 | 0.40 | 0.40 | — | 0.40 |
| | Component (D) | 2-Ethylhexyl hydrogenphosphite | mass % | 0.25 | 0.25 | 0.25 | 0.25 | — |
| | | 2-Ethylhexyl acid phosphate | mass % | — | — | — | — | — |
| | Others | Viscosity index improver (1) | mass % | 9.50 | 9.50 | 9.50 | 9.50 | 9.50 |
| | | Viscosity index improver (2) | mass % | — | — | — | — | — |
| | | Pour point depressant | mass % | 0.20 | 0.20 | 0.20 | 0.20 | 0.20 |
| | | Oleylamine | mass % | 0.05 | 0.05 | 0.05 | 0.05 | 0.05 |
| | | Tricresyl phosphate | mass % | 0.30 | 0.30 | 0.30 | 0.30 | 0.30 |
| | | Oleic acid monoglyceride | mass % | 0.25 | 0.25 | 0.25 | 0.25 | 0.25 |
| | | Polybutenylsuccinimide | mass % | 4.50 | 4.50 | 4.50 | 4.50 | 4.50 |
| | | Sulfur-containing anti-wear agent | mass % | 0.50 | 0.50 | 0.50 | 0.50 | 0.50 |
| | | Copper deactivator | mass % | 0.05 | 0.05 | 0.05 | 0.05 | 0.05 |
| | | Anti-foaming agent | mass % | 0.20 | 0.20 | 0.20 | 0.20 | 0.20 |
| | | Total | mass % | 100.00 | 100.00 | 100.00 | 100.00 | 100.00 |
| Base Oil Properties | | Kinematic viscosity of component (E) (100° C.) | $mm^2/s$ | 4.4 | 4.4 | 4.4 | 4.4 | 4.4 |
| Lubricating Oil Properties | Elements in Lubricating Oil | Nitrogen amount | mass % | 0.15 | 0.15 | 0.13 | 0.15 | 0.15 |
| | | Nitrogen amount derived from component (A) | mass % | 0.02 | 0.02 | — | 0.02 | 0.02 |
| | | Calcium amount derived from components (B) and (C) | mass % | 0.04 | 0.05 | 0.05 | — | 0.05 |
| | | Calcium amount ratio, (B)/(C) | — | 0.64 | — | — | — | — |
| | | Phosphorus amount | mass % | 0.05 | 0.05 | 0.05 | 0.05 | 0.02 |
| | | Phosphorus amount derived from component (D) | mass % | 0.03 | 0.03 | 0.03 | 0.03 | — |
| | General Properties | Kinematic viscosity (100° C.) | $mm^2/s$ | 7.1 | 7.1 | 7.1 | 7.1 | 7.1 |
| | | Viscosity index (VI) | — | 180 | 180 | 180 | 180 | 180 |
| | | Low-temperature viscosity (−40° C. BF viscosity) | mPa · s | 10200 | — | — | — | — |
| | Evaluation Results | LFW-1 intermetallic friction coefficient | — | 0.089 | 0.122 | 0.121 | 0.108 | 0.109 |
| | | Clutch shudder preventive lifetime | h | 550< | 348 | 48 | 312 | 312 |

The components in Table 1 and Table 2 are as follows.

<Component (A): Tertiary Amine>

Dimethyloctadecylamine

<Component (B): Low-Basic Metal-Based Detergent>

Low-basic calcium sulfonate: total base number (perchloric acid method); 15 mgKOH/g, calcium content; 3% by mass, sulfur content; 3% by mass <Component (C); Overbased Metal-Based Detergent>

Overbased calcium sulfonate (1): total base number (perchloric acid method); 300 mgKOH/g, calcium content; 12% by mass, sulfur content; 2% by mass Overbased calcium sulfonate (2): total base number (perchloric acid method); 400 mgKOH/g, calcium content; 15% by mass, sulfur content; 1% by mass <Component (D): One or More Selected from an Acidic Phosphate and an Acidic Phosphite>

Acidic phosphate: 2-ethylhexyl acid phosphate

Acidic phosphite: 2-ethylhexyl hydrogenphosphite

<Component (E): Lubricating Base Oil>

Lubricating base oil (1): mineral oil, 100° C. kinematic viscosity; 2.17 $mm^2/s$, viscosity index; 109, sulfur content; less than 5 ppm by mass, n-d-M ring analysis % $C_P$; 76%

Lubricating base oil (2): poly-alpha-olefin, 100° C. kinematic viscosity; 159 $mm^2/s$, viscosity index; 211

Lubricating base oil (3): mineral oil, 100° C. kinematic viscosity; 4.4 $mm^2/s$, viscosity index; 127, sulfur content; less than 5 ppm by mass, n-d-M ring analysis % $C_P$; 78%

<Others>

Viscosity index improver (1): PMA-type, mass average molecular weight (Mw) 30,000

Viscosity index improver (2): PMA-type, mass average molecular weight (Mw) 180,000

Pour point depressant: PMA-type

Primary amine: oleinamine

Tricresyl phosphate

Oleic acid monoglyceride

Polybutenylsuccinimide

Sulfur-containing anti-wear agent

Copper deactivator: thiadiazole-type metal deactivator

Anti-foaming agent: silicone-type anti-foaming agent

As obvious from the results in Table 1 and Table 2, it was confirmed that the lubricating oil compositions of Examples 1 to 6 have a high intermetallic friction coefficient and are excellent in the clutch shudder preventive life. In addition, it is also confirmed that the compositions have a high viscosity index (VI) and a low low-temperature viscosity.

On the other hand, in Comparative Example 1, the mass ratio of the metal fraction derived from the component (B) to the metal fraction derived from the component (C) (B/C) is more than 0.60, and therefore, it was confirmed that the intermetallic friction coefficient of the lubricating oil composition is extremely poor though the clutch shudder preventive lifetime is excellent.

In Comparative Example 2, the component (B) is not incorporated, and therefore, it was confirmed that the short clutch shudder lifetime is poor. In Comparative Example 3, the component (B) is not incorporated like in Comparative Example 2, and in addition, the component (A) is not incorporated, and therefore, it was confirmed that the clutch shudder preventive lifetime is extremely poor.

In Comparative Example 4, the component (B) is not incorporated like in Comparative Example 2 and, in addition, the component (C) is not incorporated, and therefore, it was confirmed that the clutch shudder preventive lifetime and the intermetallic friction coefficient are poor. In Comparative Example 5, the component (B) is not incorporated like in Comparative Example 2 and, in addition, the component (D) is not incorporated, and therefore, it was confirmed that the clutch shudder preventive lifetime and the intermetallic friction coefficient are poor.

INDUSTRIAL APPLICABILITY

The lubricating oil composition of the present invention has a high intermetallic friction coefficient and an excellent clutch shudder preventive lifetime, and in addition, has a high viscosity index (VI) and a low low-temperature viscosity. Consequently, for example, the lubricating oil composition can contribute toward fuel saving by automobiles owing to rock-up clutch fastening and slip control region enlargement, and further, even in a broad service temperature range, energy loss in driving transmissions can be stably reduced to save fuel consumption. Having such excellent characteristics, the lubricating oil composition is more favorable for use in continuously-variable transmissions equipped with a rock-up mechanism-having torque converter.

The invention claimed is:

1. A lubricating oil composition, which is prepared by blending the following components (A) to (E):

(A) a tertiary amine represented by the following general formula (1):

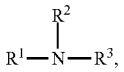

(1)

wherein $R^1$ represents a hydrocarbon group having 4 or more carbon atoms, and $R^2$ and $R^3$ each independently represent a hydrocarbon group having 1 or more and 4 or less carbon atoms;

(B) a metal-based detergent having a total base number according to a perchloric acid method of 50 mgKOH/g or less;

(C) a metal-based detergent having a total base number according to a perchloric acid method of 150 mgKOH/g or more;

(D) at least one of an acidic phosphate and an acidic phosphite; and (E) a lubricating base oil, wherein a mass ratio of a metal fraction derived from the component (B) to a metal fraction derived from the component (C) (B/C) is 0.60 or less.

2. The lubricating oil composition according to claim 1, wherein a nitrogen content derived from the component (A) is 0.005% by mass or more based on a total amount of the lubricating oil composition.

3. The lubricating oil composition according to claim 1, wherein:

the component (B) is at least one selected from the group consisting of an alkaline earth metal sulfonate, an alkaline earth metal phenate and an alkaline earth metal salicylate, each having a total base number according to a perchloric acid method of 50 mgKOH/g or less; and the component (C) is at least one selected from the group consisting of an alkaline earth metal sulfonate, an alkaline earth metal phenate and an alkaline earth metal salicylate, each having a total base number according to a perchloric acid method of 150 mgKOH/g or more.

4. The lubricating oil composition according to claim 1, wherein a total content of metal fractions derived from the component (B) and the component (C) is 0.01% by mass or more and 0.13% by mass or less based on a total amount of the lubricating oil composition.

5. The lubricating oil composition according to claim 1, wherein a phosphorus content derived from the component (D) is 0.01% by mass or more based on a total amount of the lubricating oil composition.

6. The lubricating oil composition according to claim 1, wherein the metal-based detergent (B) is at least one selected from the group consisting of a calcium sulfonate, a calcium phenate and a calcium salicylate.

7. The lubricating oil composition according to claim 1, wherein a kinematic viscosity at 100° C. of the component (E) is 1.0 $mm^2/s$ or more and 10 $mm^2/s$ or less.

8. The lubricating oil composition according to claim 1, wherein the component (E) comprises (E1) a lubricating base oil having a kinematic viscosity at 100° C. of 1.0 $mm^2/s$ or more and 5.0 $mm^2/s$ or less, and (E2) a lubricating base oil having a kinematic viscosity at 100° C. of 50 $mm^2/s$ or more and 1,000 $mm^2/s$ or less.

9. The lubricating oil composition according to claim 1, which has a kinematic viscosity at 100° C. of 10.0 $mm^2/s$ or less.

10. The lubricating oil composition according to claim 1, which has a viscosity index (VI) of 175 or more.

11. The lubricating oil composition according to claim 1, which has a Brookfield viscosity at −40° C. of 10,000 mPa·s or less.

12. The lubricating oil composition according to claim 1, which is adapted to function as a lubricating oil composition for continuously-variable transmissions.

13. The lubricating oil composition according to claim 1, wherein the metal-based detergent (C) is at least one selected from the group consisting of a calcium sulfonate, a calcium phenate and a calcium salicylate.

14. The lubricating oil composition according to claim 1, wherein:

component (A) comprises at least one member selected from the group consisting of dimethylhexadecylamine, dimethyloctadecylamine, dimethylheneicosylamine, diethyloctadecylamine, and methylethyloctadecylamine;

component (B) comprises at least one member selected from the group consisting of a calcium sulfonate, a calcium phenate, and a calcium salicylate;

component (C) comprises at least one member selected from the group consisting of a calcium sulfonate, a calcium phenate, and a calcium salicylate;

component (D) comprises at least one member selected from the group consisting of monoethyl acid phosphate, mono-n-propyl acid phosphate, mono-n-butyl acid phosphate, mono-2-ethylhexyl acid phosphate, diethyl acid phosphate, di-n-propyl acid phosphate, di-n-butyl acid phosphate, di-2-ethylhexyl acid phosphate, monoethyl hydrogenphosphite, mono-n-propyl hydrogenphosphite, mono-n-butyl hydrogenphosphite, mono-2-ethylhexyl hydrogenphosphite, dihexyl hydrogenphosphite, diheptyl hydrogenphosphite, di-n-octyl hydrogenphosphite, and di-2-ethylhexyl hydrogenphosphite; and component (E) has a kinematic viscosity at 100° C. of 2.0 $mm^2/s$ to 6.5 $mm^2/s$.

15. The lubricating oil composition according to claim 14, wherein:

component (A) is blended in an amount of 0.3% by mass to 1.0% by mass based on the total mass of the lubricating oil composition;

component (B) is blended to provide a metal-equivalent amount of 0.002% by mass to 0.02% by mass based on the total mass of the lubricating oil composition;

component (C) is blended to provide a metal-equivalent amount of 0.015% by mass to 0.08% by mass based on the total mass of the lubricating oil composition;

component (D) is blended to provide a phosphorus amount of 0.02% by mass to 0.09% by mass based on the total mass of the lubricating oil composition; and component (E) is blended in an amount of 70% by mass to 95% by mass based on the total mass of the lubricating oil composition.

16. The lubricating oil composition according to claim 15, wherein:

component (A) comprises dimethyloctadecylamine;

component (B) comprises a calcium sulfonate;

component (C) comprises a calcium sulfonate; and component (D) comprises at least one member selected from the group consisting of a 2-ethylhexyl acid phosphate and a 2-ethylhexyl hydrogenphosphite.

* * * * *